United States Patent [19]

O'Leary

[11] Patent Number: 4,490,707

[45] Date of Patent: Dec. 25, 1984

[54] EXPLOSIVELY-ACTUATED, MULTI-GAP HIGH VOLTAGE SWITCH

[75] Inventor: Raymond P. O'Leary, Evanston, Ill.

[73] Assignee: S&C Electric Company, Chicago, Ill.

[21] Appl. No.: 539,396

[22] Filed: Oct. 6, 1983

Related U.S. Application Data

[63] Continuation of Ser. No. 179,366, Aug. 18, 1980, abandoned.

[51] Int. Cl.[3] ..... H01H 85/18; H01H 33/06

[52] U.S. Cl. ..... 337/6; 200/61.08; 337/158; 337/401

[58] Field of Search ..... 337/30, 115, 402, 143, 337/156, 401, 4, 6, 158-162, 412, 148, 251, 275, 282; 200/82 B, 150 M, 61.08

[56] References Cited

U.S. PATENT DOCUMENTS

| | | | |
|---|---|---|---|
| 2,247,815 | 7/1941 | Lohausen | 337/238 |
| 3,076,076 | 1/1963 | Bridges | 200/114 |
| 3,118,986 | 1/1964 | Lewis et al. | 200/82 |
| 3,129,307 | 4/1964 | Vargas | 200/144 |
| 3,144,536 | 8/1964 | Bridges et al. | 200/146 |
| 3,308,259 | 3/1967 | Hulteen et al. | 200/146 |
| 3,356,808 | 12/1967 | Dakin et al. | 200/140 |
| 3,984,651 | 10/1976 | Lewis et al. | 200/144 |
| 4,013,852 | 3/1977 | Roberts et al. | 200/146 |
| 4,342,978 | 8/1982 | Meister | 337/6 |
| 4,370,531 | 1/1983 | Tobin | 200/151 |

FOREIGN PATENT DOCUMENTS

| | | | |
|---|---|---|---|
| 662342 | 7/1938 | Fed. Rep. of Germany . | |
| 1904227 | 8/1970 | Fed. Rep. of Germany | 337/401 |

OTHER PUBLICATIONS

Fuji Electric Review, vol. 18, No. 1, pp. 49-51, 1972.

Load Management Switches—The Saf-T-Gap Interrupter, Section 1005, p. 3, Jul., 1967—A. B. Chance Co.

Ultra-High Speed Ground Switch Application and Development, E. R. Perry and A. M. Frey, AEEI Transactions Paper No. 62-1109.

*Primary Examiner*—William H. Beha, Jr.

*Attorney, Agent, or Firm*—Kirkland & Ellis

[57] ABSTRACT

A high-speed switch usable at high voltage includes a pair of contacts movable apart along a fixed line. When the contacts are normally interconnected, at least one of them contributes to the definition of an enclosed chamber. Pressurization of the chamber by the ignition of a power cartridge therein rapidly drives the contacts apart, forming a first gap between them. The first gap is electrically insulated and is shielded from the ignition products of the cartridge. Any arc forming in the first gap is constricted and subjected to arc-extinguishing gas. When the contacts are interconnected, a first one of them is electrically connected to a terminal. After the contacts move apart, a second gap forms between the first contact and the terminal. The second gap is electrically insulated and is shielded from the ignition products of the cartridge. A fuse may be connected in shunt with the contacts and the insulated gaps. Preferably, the shunt connection is made after the first gap is formed, but before the second gap is formed. This permits the first gap to effect commutation of current from the switch to the fuse and the second gap to be formed after the communtation. The second gap thus experiences no or only limited arcing and remains essentially uncontaminated so that recommutation of current from the fuse to the switch is prevented.

18 Claims, 2 Drawing Figures

EXPLOSIVELY-ACTUATED, MULTI-GAP HIGH VOLTAGE SWITCH

This is a continuation of application Ser. No. 179,366 filed Aug. 18, 1980, now abandoned.

BACKGROUND OF THE INVENTION

1. Field of the Invention

The present invention relates to an improved electric switch and to an improved device using the improved switch. More specifically, the present invention constitutes an improvement of the invention claimed in commonly-assigned U.S. patent application Ser. No. 972,650, filed Dec. 21, 1978 (now abandoned) in the name of Otto Meister Ser. No. 21,646, filed Mar. 19, 1979 in the name of Otto Meister, which issued as U.S. Pat. No. 4,342,978 on Aug. 3, 1982.

The '650 application relates to a circuit-protection device which includes a first current path having a high continuous current-carrying rating. A pair of normally electrically interconnected contacts are included in the first path. The contacts are relatively movable apart along a fixed line of direction. When the contacts move apart, the electrical interconnection therebetween is broken to open the first path. When the contacts are electrically interconnected, at least one of them defines a portion of an enclosed chamber. An ignitable device, such as a power cartridge, is included in the chamber for pressurizing it upon ignition thereof to rapidly drive the contacts apart. A second current path is in electrical shunt with the contacts and physically surrounds the first path. The second path may include a fuse or a fusible element which may be either current limiting or non-current limiting. The first path normally shunts away from the fusible element the majority of the current passing through the device. Only when the contacts move apart is current commutated to the fuse which then interrupts such current. Preferably, the power cartridge is ignited to move the contacts apart in response to the occurrence of a fault current or other over-current in a circuit in which the device is connected. As more fully explained in the '650 application, in this way current-limiting fuses, which may have high fault current interrupting ratings but which can carry only low continuous currents may be used to protect circuits having high continuous currents because the first path (including the contacts), and not the fuse, normally carries the majority of the current in the circuit.

BRIEF DISCUSSION OF THE PRIOR ART

A fault current (used herein to mean any undesirable over-current) impresses rather stringent thermal and mechanical stresses on high-voltage electrical systems and on apparatus used in such systems. The severity of the thermal stress is known to be generally proportional to the product of (1) the square of the fault current, and (2) time—that is, $I^2t$. The severity of the mechanical stress is generally proportional to the square of the peak or crest value achieved by the fault current. Thermal stresses are generally manifested in the burning down of, or other thermal damage to, lines, cables, and equipment. Mechanical stresses are manifested in the deformation of bus work and switches and in damage to items, such as transformers or reactor coils, due to the extermely high magnetic forces generated by a fault current.

Current-limiting fuses including the so-called silver-sand variety are well known expedients for limiting the magnitude of fault currents. See the following commonly-assigned U.S. Pat. No. 4,063,203 to Bernatt; U.S. Pat. No. 4,057,775 to Biller; U.S. Pat. No. 4,035,753 to Reeder; U.S. Pat. No. 4,028,656 to Schmunk and Tobin; U.S. Pat. No. 4,011,537 to Jackson and Tobin; and U.S. Pat. No. 4,010,438 to Scherer. In interrupting a fault current, a current-limiting fuse limits both the peak thereof and $I^2t$ to tolerable levels, thereby minimizing thermal and mechanical stresses. These tolerable levels of peak fault current and $I^2t$ are often termed the "let through current" or simply "let through." As is well known, current-limiting fuses, particularly at higher voltages, have relatively low continuous current ratings which impose limitations on the applicability thereof.

As electrical systems have expanded and electrical consumption has increased, continuous current in such systems has also increased. Because of the low continuous current rating of conventional silver-sand current-limiting fuses, such fuses have limited applicability in the systems. The low continuous current rating of current-limiting fuses is apparently inherent. Most known current-limiting fuses cannot meet both the requirements of low "let through" and high continuous current rating without some modification or the addition of some special apparatus. Further, fault current levels have begun to exceed the capabilities of existing switchgear. If, in order to avoid the occurrence of increased fault currents, electrical systems are arranged so that they contain individual sections having low available fault currents, or if current limiting reactors, high impedance transformers, or the like are used, certain disadvantages may nevertheless result. For example, sectionalizing and the use of current limiting reactors are uneconomical and may render satisfactory voltage regulation difficult to achieve. These techniques also usually result in an over-abundance of idle reserve in the electrical system. Thus, unless an economical and reliable current-limiting fuse having a high continuous current rating becomes generally available, the only solution—a costly one—to the problems engendered by increased fault current levels is to replace existing switchgear with gear having higher fault and over-current withstand capabilities and higher interrupting capabilities. Accordingly, the fault limiting properties of current-limiting fuses have been, and remain, the subject of great interest.

Twenty or so years ago, a device, sometimes referred to as an "$I_s$ Limiter," was developed by Calor-Emag Corporation (now a division of Brown Boveri of West Germany). The $I_s$ Limiter is constructed with a high continuous-current-capacity, main conductive path which is electrically paralleled with a more or less standard current-limiting fuse. The current-limiting fuse may be of the well known silver-sand type having a silver fusible element surrounded by a fulgurite-forming, arc-quenching medium, such as silica or quartz sand. The main conductive path of the $I_s$ Limiter includes a so-called "bursting bridge" which, upon detonation of a chemical charge contained therewithin in response to a fault current, renders the main conductive path discontinuous and rapidly transfers or commutates the current in the main conductive path to the current-limiting fuse.

The bursting bridge is comprised of a pair of tubular sections, each open at one end and containing a series of longitudinal slots over the majority of its length. The open ends of the tube sections are joined along a brazed, weak interface to enclose the chemical charge. Detonation of the chemical charge breaks the weak interface, blowing up the bursting bridge, and bending fingers defined between the slots of each section out and back in a "banana peel" configuration; this renders discontinuous the main conductive path. See U.S. Pat. No. 2,892,062 to Brückner, et al. This discontinuity in the main conductive path transfers or commutates the current to the current-limiting fuse, which current is then interrupted in a conventional manner common to silver-sand current-limiting fuses. The chemical charge is detonated by means of a pulse transformer or other device contained in one of two insulators which mounts the current-limiting fuse and the main conductive path, each of which is housed in its own independent, individual, insulative housing. When the bursting bridge is blown apart, an arc typically forms between the tube sections. Sometime thereafter, the arc voltage is sufficiently high to commutate the current to the fuse so that interruption thereby may occur.

If not properly fabricated, the bursting bridge may not fully open. Further, it has been found that the gap between the bent back fingers of the tube sections may be contaminated or ionized by the chemical charge or the arc. Specifically, when the chemical charge detonates, hot ignition products—gaseous and solid—fill the gap. These ignition products lower the dielectric strength of the gap. So too, the action of the arc—the formation of which itself involves ionization of gas in the gap—on metallic or non-metallic materials in the vicinity thereof produces ionization of the gap, further lowering the dielectric strength thereof. Such ionization, due to either or both causes, may permit the arc to persist or may lower its voltage, thus slowing or preventing commutation of the current to the current-limiting fuse. It has also been found, however, that the dielectric strength across the gap may recover, or at least increase rather quickly after about 200 microseconds. Therefore, the current-limiting fuse of the $I_s$ Limiter must be so designed and constructed as to (a) overlap the "dead time" of the bursting bridge until the 200 microsecond time passes and then (b) limit and interrupt the current. Following the initial 200 microseconds, voltage stress across the gap has been found to be rather low due to the lower resistance of the fusible element as compared to that of the gap. Thus, the $I_s$ Limiter is a current-limiting device combining a fast-acting switch having a high continuous current capability, but poor current interrupting capability with an electrically parallel current-limiting fuse having a low continuous current capability but high current limiting and interrupting ability.

Several disadvantages of the $I_s$ Limiter should be noted. First, the current-limiting fuse and the main conductive path form two separate elements in their own separate housings. This arrangement is not only somewhat clumsy and difficult to manipulate during replacement or initial placement, but increases material costs due to the duplication of certain elements such as housings, end ferrules, conductors, and the like. This first disadvantage of the $I_s$ Limiter is obviated by the invention claimed in the '650 patent application, wherein a high continuous-current-capability, fast-acting switch, and an electrically parallel current-limiting fuse are contained in the same housing. A second disadvantage of the $I_s$ Limiter relates to the fact that speed of commutation of the current in the main current path to the current limiting fuse may be slowed by the relatively high inductance of the main conductive path and current-limiting fuse combination. This second disadvantage of the $I_s$ Limiter is also obviated by the invention claimed in the '650 patent application by surrounding the main current path with the current-limiting fuse to minimize the inductance of the combination, as described more fully in that patent application.

A third disadvantage of the $I_s$ Limiter is that there is a practical limitation to the length of the gap that can be formed by the bursting bridge. Specifically, only so much chemical charge may be confined within a practical volume of the bursting bridge to ensure that the fingers defined by the slots into the two tube sections are sufficiently blown outwardly and bent backwardly. That is, the tube sections could be greatly elongated and filled with a chemical charge of larger size so that detonation bends back fingers of increased length. Both the increased size of the charge and the length of the fingers, however, require a larger housing of higher burst strength, adding to the cost and inconvenience of the overall device. This third disadvantage of the $I_s$ Limiter is obviated by the invention claimed in the '650 patent application. Specifically, rather than including a bursting bridge, the high-speed switch of the invention of the '650 patent application comprises a pair of normally electrically connected contacts which are driven apart along a fixed line by the ignition of a power cartridge. In this way, the switch of the '650 patent application does not depend upon the fracturing (blowing apart) and peeling back of portions of the main current path as is the case with the $I_s$ Limiter; rather, the contacts are positively driven and moved apart, ensuring that a large gap is opened therebetween. See also German Offenlegungsschrift No. 1,904,244 published Aug. 6, 1970 and a related article entitled "Ultra-High Speed Protection Device—Fuji Ultrup Fuse" in the *Fuji Electric Review*, Vol. 18, No. 1 (1972) Pages 49–51.

A fourth disadvantage of the $I_s$ Limiter, alluded to above, relates to the fact that some coordination between the operation of the current-limiting fuse and the dielectric recovery of the gap formed between the tubular sections of the bursting bridge may be necessary. Due to the vagaries of fault current conditions in high-voltage circuits, this coordination may prove difficult to achieve. Both the invention of the '650 patent application, as well as the device of the German Offenlegungsschrift and the Fuji article suffer from a similar disadvantage. Simply stated, the need to await the dielectric recovery of the gap is due to contamination of the gap by both the ignition products of the chemical charge and the formation of the arc, as described earlier. Even ignoring gap contamination by the ignition products of the chemical charge, there is evidence that where a single gap is opened, as occurs in the prior art devices so far discussed, a sufficiently high arc voltage may not always predictably exist at an early enough time to transfer current to the fuse to ensure appropriate fault current limitation and interruption. Moreover, even where current does transfer to the fuse, the operation of the fuse may involve an arc voltage sufficiently elevated to retransfer current to the main path and defeat the protective function of the device.

The above-described need for coordination insofar as it is due to dielectric recovery problems or gap contamination has been at least partly solved by the invention of commonly assigned U.S. patent application, Ser. No. 021,646, filed Mar. 19, 1979 in the name of Otto Meister.

In that invention, which constitutes an improvement of the invention of the '650 patent application, one of the contacts mounts a piston. The piston is preferably insulative and may be made of an ablative, arc-extinguishing material. The piston is also configured so that when the power cartridge is ignited to pressurize the chamber and drive the contacts apart, the piston is forced into intimate contact with the walls of a sleeve-like liner, also preferably made of an ablative arc-extinguishing material. In this way, the contact which mounts the piston is isolated from the ignition products of the power cartridge and other gap contaminants. Also, the engagement between the piston and liner constricts and subjects to the action of de-ionizing, arc-extinguishing gas any arc that forms between the contacts following their movement apart similar to so-called trailer-liner interrupters. Such constriction and arc-extinguishing gas tend to elevate the arc voltage or extinguish the arc (or both), either of which increases the liklihood that current will be commutated to the fuse. Further, the isolation of the contact by the piston from contaminants—whether produced by the power cartridge or the arc itself—tends to ensure that the gap has a high dielectric strength as the fuse operates, thus inhibiting retransfer of the current from the fuses to the main path. Thus, the invention claimed in the '646 patent application takes long strides toward solving the coordination and dielectric recovery problems of the $I_x$ Limiter, the device of the '650 application and the devices of the German Offenlegungsschrift and the Fuji Electric Review.

Nevertheless, the invention claimed in the '646 patent application, as do earlier inventions, depends for current commutation to the fuse on the opening of a single gap. It has been postulated that even where the invention of the '646 application is used, a single gap may not reliably ensure current commutation of the type resulting in appropriate current limitation and interruption for at least two possible reasons. First, the arc in the single gap both contaminates the gap due to its effect on metal parts and erodes the piston and the liner of the '646 application where such arc used. This erosion may permit contaminated to be distributed across a portion of the entire gap and to be present in the vicinity of both contacts. In this event the contaminants may prevent sufficient elevation of the arc voltage to appropriately commutate current to the fuse. Second, even if the current is commutated to the fuse—either by a sufficiently high arc voltage or by extinguishment of the arc through the action of the piston and the liner—when the fuse operates to limit and interrupt the fault current, a sufficiently high arc voltage may occur so that current in the fuse attempts to retransfer to the main path. If the single gap is sufficiently contaminated for any reason, an arc may reform therein which may result in retransfer of the current to the main path and a failure of the switch-fuse combination to perform its intended function.

Accordingly, the present invention constitutes, in general, an improvement of the invention claimed in the '650 and '646 patent applications and, more specifically, a solution to the coordination and dielectric recovery problems residing in prior art devices. Additional background and discussion of the prior art is more fully set forth in the '650 and '646 applications, which are specifically incorporated by reference hereinto.

SUMMARY OF THE INVENTION

The present invention relates to an electrical switch for opening a first current path in which the switch is included. The switch includes a pair of normally interconnected contacts which carry current in the first current path. The contacts are relatively movable apart along a fixed line of direction to form a first gap and to break the electrical interconnection therebetween. At least one of the interconnected contacts and an insulative, piston-like member carried by the other contact define or aid in defining an enclosed chamber. The chamber includes an ignitable facility, such as a power cartridge, for pressurization thereof which rapidly drives the contacts apart. This piston-like member ensures that the contacts are efficiently driven apart, isolates the other contact from the ignition products of the power cartridge and other contaminants which may be in the first gap, and laterally constricts any arc formed in the first gap between the contacts. To this point, the improved high-voltage switch is similar to the invention claimed in the '646 application.

The improved switch of the present invention also includes a terminal in the first current path. Facilities are included for electrically connecting the other contact to the terminal when the contacts are electrically interconnected. In this fashion, the terminal and the contacts are in series in the first current path. These latter facilities also form a second gap between the other contact and the terminal when the contacts move apart and electrically insulate the second gap. Accordingly, in the improved switch, two insulated gaps are open. The first gap is opened between the contacts, while the second gap is opened between the other contact and the terminal. The opening of two insulated gaps ensures the opening of the first current path.

In alternative embodiments, a second current path, which preferably includes a current-limiting fuse, is connected in shunt with the first path (which includes the terminal and the contacts) at a predetermined time relative to the opening of the gaps. The opening of the two insulated gaps in the first current path ensures that (1) the arc voltage thereof is sufficiently high to ensure rapid transfer of current in the first current path to the second current path, and (2) generation of arc voltage by the fuse does not retransfer current in the second current path back to the first current path. Furthermore, the dielectric withstand of the open first path is increased by isolating both gaps from the ignition products of the power cartridge and from other contaminants to ensure that after the switch opens and the fuse operates, the first current path does not again conduct current.

In preferred alternative embodiments, the opening of the first gap is followed by the formation of an arc between the contacts. The piston-like member on the one contact constricts the arc and isolates the other contact from ignition products of the power cartridge and from other contaminants as described above, to elevate the arc voltage in the first gap. As the arc voltage elevates, the second current path is connected in shunt with the first current path. Current is transferred to the second path due to the elevated arc voltage. After current transfer occurs, the second gap is opened. Because there is no current in the first path at the time the second gap opens, no arc forms in the second gap. Because of the absence of an arc in the second gap and because of the isolation of the second gap from the ignition products of the power cartridge and other contaminants, the second gap is substantially, if not totally, uncontaminated by any conductive or arc-encouraging substances, such as ionized gases. As the fuse in the second path operates to interrupt the current therein, the arc voltage of the second path elevates. However, the presence of two gaps in the first path, which are uncontaminated—and have very high dielectric strength—prevents re-transfer of the current from the second path to the first path.

DETAILED DESCRIPTION

Figure 1:
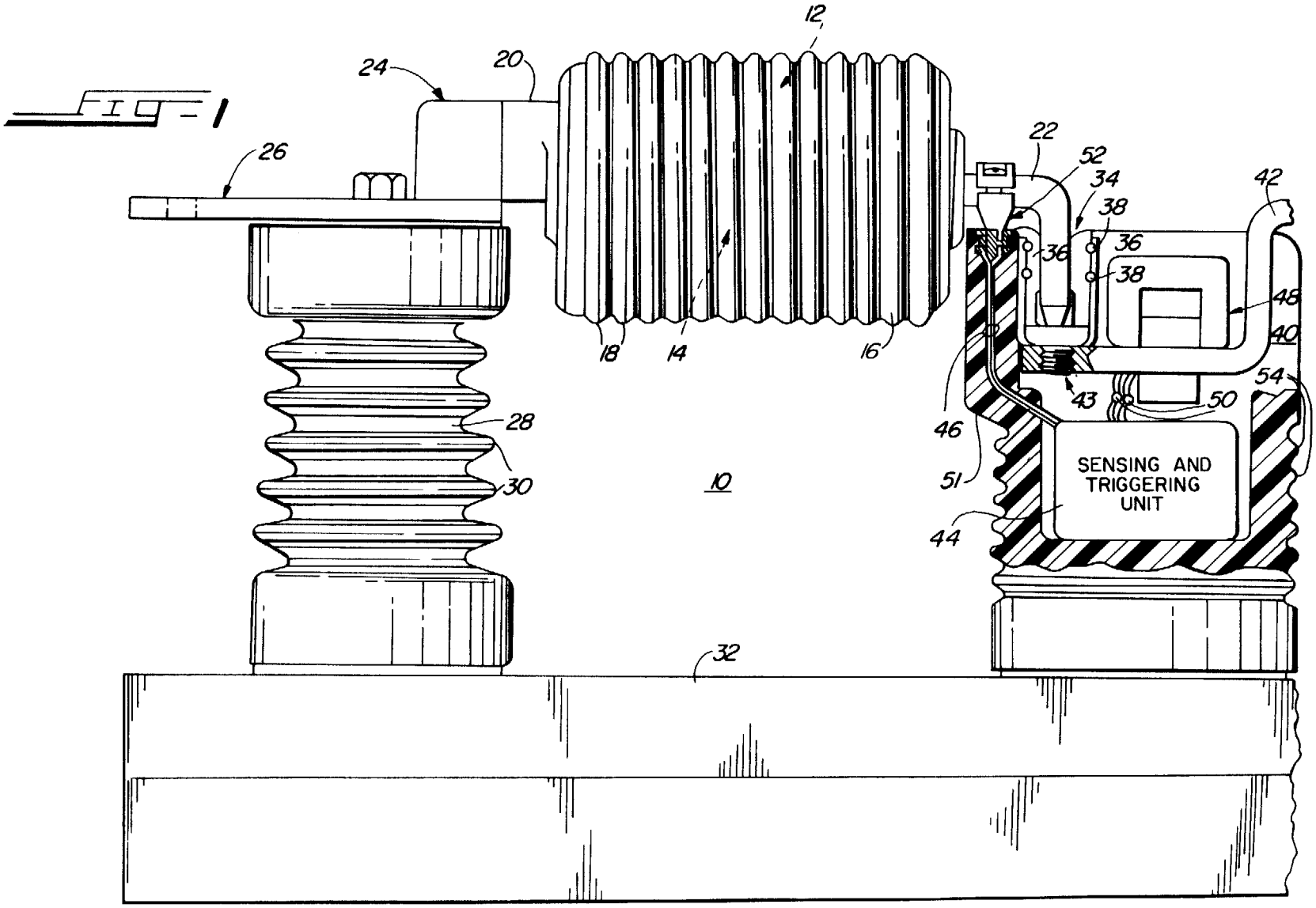
FIG. 1 depicts a side elevation of the exterior of a high voltage device in accordance with the principles of the present invention; the device, which includes a fuse and an improved switch according to the invention, is mounted between a pair of insulators, one of which is partially sectioned to generally depict a sensing and triggering unit contained therein.

Referring first to FIG. 1, there is shown a general exterior view of a novel electrical device 10 in accordance with the principles of the present invention. The novel device 10 may be usable at high voltages and may include a high-voltage fuse, generally indicated at 12, and a novel high-voltage switch, generally indicated at 14, both contained within an outer, elongated, insulative housing 16. The fuse 12 may be either current limiting or non-current limiting, although the former is preferred. The outer housing 16 may include a plurality of leakage-distance-increasing skirts 18, as is well known, and may be made of porcelain or other insulative material, such as molded cyclophatic epoxy resin. The outer housing 16 may surround an inner housing 19 (see FIG. 2) preferably made of glass-fiber-reinforced epoxy. The switch 14 may be contained by the inner housing 19, while the fuse 12 may be located between the housings 16 and 19, as described more fully below.

Extending from one end of the housing 16 is a first terminal 20 which is connected to various elements within the housings 16 and 19 in a manner to be described below. Extending from the outer end of the housing 16 is a second terminal 22 which is also connected to elements within the housings 16 and 19. The terminal 20 may be detachably connectable in any convenient fashion to a mounting facility 24 which may be formed integrally with or otherwise suitably connected to a cable or line attachment facility 26. One cable or line (not shown) of a circuit (not shown) to be protected by the device 10 is attached in any convenient manner to the attachment facility 26. The mounting facility 24 and the cable-attachment facility 26 are supported by and are attached to a support insulator 28 formed of porcelain or other convenient insulative material, such as cycloalphatic epoxy resin. The insulator 28 may include a plurality of leakage-distance-increasing skirts 30 and is supported on a common base 32 which may be a structural steel member or the like.

The other terminal 22 may have any convenient configuration, the inverted L-shape depicted in FIG. 1 being one example thereof. The terminal 22 is detachably engageable by a mounting facility 34. If the terminal 22 has a generally circular cross-section, the mounting facility 34 may comprise a plurality of contact fingers 36 (only two are shown), spring-biased into intimate engagement with the terminal 22 by one or more garter springs 38. The mounting facility 34 may be molded in as an integral part of an insulator 40 which may be made of porcelain, a cycloalphatic epoxy resin, or other suitable insulative material. Also contained within the insulator 40 may be a conductor 42, which is continuously connected to the fingers 36 as at 43, and which is connectable to another cable or line (not shown) of the circuit (not shown) being protected by the device 10.

A sensing and triggering unit 44 generates appropriate output signals on output conductors 46 for a purpose to be described below in response to the condition of current in the conductor 42, which may be sensed by a current transformer 48. The unit 44 and the transformer 48 may be integrally molded into the insulator 40. The current transformer 48 and the sensing and triggering unit 44 are interconnected by appropriate leads 50. The output conductors 46 of the sensing and triggering unit 44 may pass through both a portion 51 of the insulator 40 and an appropriate detachable clamp member 52 surrounding the terminal 22. The output conductors 46 may enter the interior of the housings 16 and 19 through the terminal 22 which may be hollow or bored out for this purpose. The insulator 40 may include a plurality of leakage-distance-increasing-skirts 54 and is attached to the common base 32. The present invention contemplates that the unit 44 and/or the transformer 48 may be located other than in the insulator 40. For example, the unit 44 may be within the housing 16 or in a separate housing (not shown) attached to or formed integrally with the housing 16. In this latter event, the structure of the terminal 22, the mounting facility 34, and the insulator 40 may well vary from that depicted in FIG. 1.

The insulators 28 and 40 on the one hand, and the device 10 on the other hand, as shown in FIG. 1, have respective vertical and horizontal orientations. Any of these components may be mounted in any other desired orientation, as should be obvious. The unit 44 and the transformer 48 may be reusable; only the fuse 12 and the switch 14 in their common housing 16 require replacement following operation of the device 10.

Figure 2:
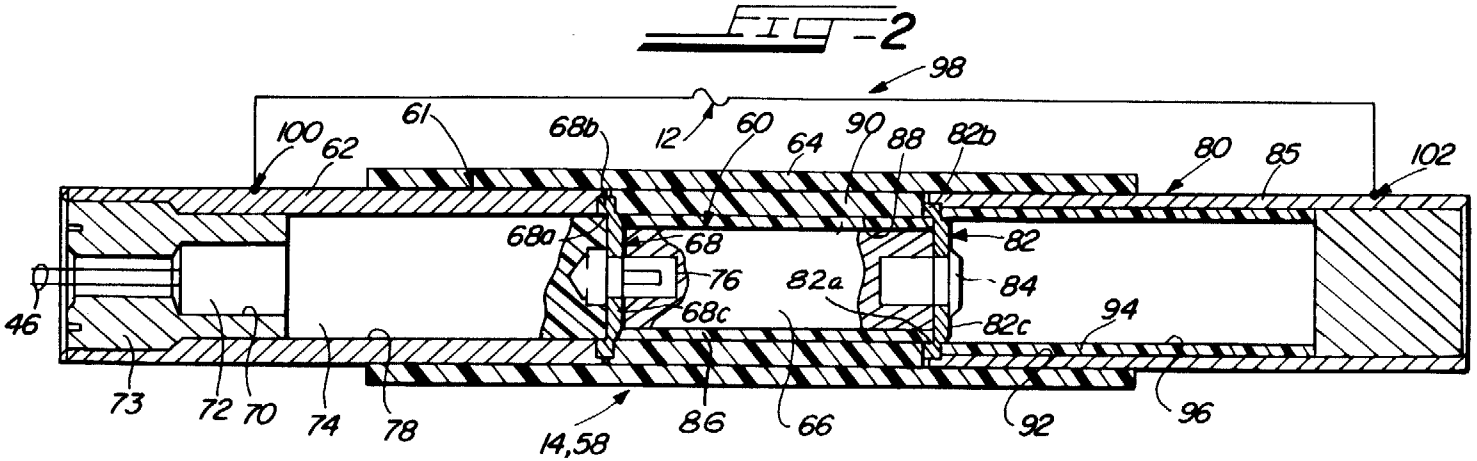
FIG. 2 is a partially sectioned, side elevational view of a preferred alternative embodiment of a switch usable with the device of FIG. 1 according to the principles of the present invention.

Referring now to FIG. 2, there is shown a preferred embodiment of the present invention. In the switch 14' of FIG. 2, two insulated gaps are opened. Also, electrical connection of the second path 98 to the first path 58 is timed with respect to the formation of the two gaps to ensure improved operation of the device 10.

In FIG. 2 the contact 61 comprises a tube of cup-shaped member 62' which may be attached to or formed integrally with an end member 104. The tube 62' and the end member 104 together define the chamber 70 for the power cartridge 72 in combination with the trailer 74, resembling to a certain extent the piston depicted in the '646 application. The end member 104 may be formed integrally with or otherwise electrically connected to the terminal 22 depicted in FIG. 1. Through the end member 104 may pass the output conductors 46 of the sensing and triggering unit 44, also shown in FIG. 1.

As noted immediately above, the trailer 74' of FIG. 2 has a piston-like configuration and conformally moves through the bore 78 formed in the tube 62'. The trailer 74' is attached to the contact 60. The contact 60 comprises a metallic conductive tube 106 which has a greater diameter at the left thereof than it does at the right thereof. The tube 106 is connected to or formed integrally with a body member 108, also made of a conductive material to which is attached, as convenient, the trailer 74'. A diaphragm 68', normally electrically interconnects the tube 62' and the body member 108. In this way, the contacts 60 and 61 are normally electrically interconnected. Movement of the trailer 74' due to pressurization of the chamber 70 by the power cartridge 72 moves such trailer 74', as well as the body member 108 and the tube 106 rightwardly.

The larger diameter portion of the tube 106 is lined with an insulative sleeve 110, preferably made of an ablative, arc-extinguishing material. The smaller diameter portion of the tube 106 is preferably unlined and defines a bore 112 which is continuous with and shaped similarly to a bore 114 defined by the sleeve 110.

The tube 106 also carries on its exterior a sleeve 86' which extends somewhat to the right of the tube 106. Carried by or embedded in the sleeve 86' is an annular conductive member or bridge 116 which serves a function described below. Both the sleeve 86' and the bridge 116 are carried by and move with the tube 106.

An insulative cylinder 64', is attached to or mounts both the tube 62' and the end member 104. The cylinder 64' also carries the insulative sleeve 90 preferably made of an ablative arc-extinguishing material. The trailer 74', the body member 108, and the tube 106 with the sleeve 86' thereon, as well as the bridge 116 carried by the sleeve 86', are conformally movable through the bore 88 defined by the sleeve 90.

The terminal 80 comprises a conductive rod-like member 118 terminating in an enlarged head 120. The head 120 is conformally movable through the bores 112 and 114 as the contact 60 moves rightwardly, and is normally maintained in sliding electrical engagement with the bore 112 defined by the tube 106. The outside of the rod 118 is covered by an insulative sleeve 122, preferably made of an ablative, arc-extinguishing material. The rod 118 may be mounted to or formed integrally with an end member 124, which may in turn be connected to or formed integrally with the terminal 20 depicted in FIG. 1. The housing 16 depicted in FIG. 1 may be maintained around the elements thus far described by end ferrules 126 which are attached between such housing 16 and the respective end members 104 and 124. The cylinder 64' may serve as a support about which the fuse, shown only schematically at 12, may be wound. If the fuse 12 is the preferred silver-sand current-limiting variety, its element may be supported by the cylinder 64' and is surrounded by sand occupying the volume defined between the outer housing 16 and the cylinder 64' acting as the inner housing 19.

In the operation of the device 10 depicted in FIG. 2, which contains the switch 14' thus far described, a normal first current path 58 exists between the terminals 22 and 20 in FIG. 1 as follows: the member 104, the tube 62', the diaphragm 68', the body member 108, the tube 106, the interface between the tube 106 and the head 120, the rod 118, and the end member 124. Upon ignition of the power cartridge 72, the trailer 74' and the contact 60 are moved rapidly to the right. Rightward movement of the contact 60 severs, tears, or rips the diaphragm 68, breaking the normal electrical interconnection between the tube 106 and the tube 62'. The piston 74', because of its configuration, ensures efficient rightward movement of the contact 60. This rightward movement isolates the tube 106 and the body member 108 from the ignition products of the power cartridge 72 and constricts any arc forming between the tube 62' and the body member 108. If the trailer 74' and the sleeve 90 are made of the preferred arc-extinguishing material, any arc forming between the contacts 60 and 61 has its voltage elevated and may be extinguished. Thus, a first gap, is formed between the tube 62' and the body member 108. The first gap is insulated by the interposition of the trailer 74' and the sleeve 90 between the contacts 60 and 61.

In the embodiment of FIG. 2, a second gap is formed, but not immediately. Specifically, during the initial portion of the rightward movement of the contact 60, sliding electrical contact between the head 120 and the wall 112 of the tube 106 prevents formation of the second gap. Ultimately, the head 120 engages the bore 114 defined by the sleeve 110. At this point, electrical connection between the head 120 and the tube 106 is broken; immediately thereafter, the rightward portion of the bore 114 of the sleeve 110 engages the sleeve 122 on the rod 118. Thus, only after a certain amount of rightward travel of the contact 60 is a second insulated gap opened between the contact 60 and the terminal 80.

The switch 14' of FIG. 2 preferably delays the connection of the second path 98 to the first path 58 until sometime after the first gap is opened but before the second gap is opened. Specifically, the second path 98 may have one point of connection 100 directly to the contact 61 as shown. The other point of connection 102', however, is normally not electrically connected to the first current path 58. The second connection point 102' may take the form of a stud 128 connected to one end of the second path 98 and passing through the cylinder 64' and the sleeve 90 as shown. A second stud 130, which similarly passes through the cylinder 64' and the sleeve 90, is diametrically opposite the stud 128 and is electrically connected by a conductor 132 to the end member 124, as shown. In the embodiment of FIG. 2, after the first gap is opened and insulated between the contacts 60 and 61, but while the contact 60 and the terminal 80 are still connected, the bridge 116, which is being carried rightwardly due to rightward movement of the contact 60, simultaneously engages the studs 128 and 130. At this time, the second path 98 is electrically connected in shunt to the first path 58 between the end member 124 and the end member 104. At the time of the connection of the second path 98 to the first path 58, the action of the trailer 74' and the sleeve 90 has, as described above, either elevated the voltage of, or extinguished the arc in the first gap. Thus, when the second path 98 is connected in shunt with the first path 58, current formerly in the first path 58 is commutated to the second path 98. The fuse 12 in the second path 98 begins to operate, that is, to interrupt the commutated current in either a current-limiting or a non-current limiting mode. As is well known, fuse operation typically involves the formation of one or more arcs, the voltage of which elevates as arc-extinguishing action occurs. As the fuse 12 operates, the second gap is opened by the action of the sleeves 86' and 122. If the current has commutated to the second path 98, the second gap is opened at a time when no current is in the first path 58 and no arc forms in the second gap. Thus, the second gap is virtually uncontaminated by either the ignition products of the power cartridge 72 or by the action of any arc therein. Accordingly, the elevated arc voltage of the fuse 12 is unable to retransfer current to the first path due to the high dielectric strength thereof effected by the presence of two gaps therein, one of which is substantially uncontaminated.

It should be obvious to those skilled in the art that the formation of the second gap and the connection of the second path 98 to the first path 58 may be adjuted to occur at any predetermined time after the formation of the first gap. Thus, depending on the voltage and current of the circuit to which the device 10 is connected, commutation of the current and prevention of current retransfer can be ensured by appropriate selection of the dimensions and relative positions and configurations of the tube 106, the rod 118, the sleeves 86', 110 and 122, the bridge 116, and the studs 128 and 128.

The preferred embodiment of FIG. 2 also contemplates that it may not be necessary or possible to form the second gap when no current is in the first path 58. For example, the second gap may be formed at a time when an arc is still present in the first gap (and current is still in the first path 58) either by design or due to the inability of the trailer 74' and the cylinder 64' to extinguish the arc, given the voltage and current conditions of the circuit to which the device 10 is connected. In this event, the formation of the second gap may act in aid of the frst gap by extinguishing or raising the arc voltage of a second arc formed therein. Moreover, the connection of the second path 98 is shunt with the first path 58 may be timed to precede or follow the formation of the second gap, again in view of the voltage and current conditions of the circuit.

Various other changes may be made in the above described embodiments of the present invention without departing from the spirit and scope thereof. Such changes, as are within the scope of the claims that follow, are intended to be covered thereby.

I claim:

1. An electrical switch for opening a first current path in which the switch is included, comprising:

a pair of normally electrically interconnected contacts which are separable along a first line of direction to both break the electrical interconnection and to form a first gap therebetween;

first means for inserting a solid electrical insulator between the contacts as they separate to electrically insulate the first gap;

a terminal in the first path;

second means for electrically connecting one contact to the terminal when the contacts are interconnected, a second gap forming between the one contact and the terminal as the contacts separate at a predetermined time after the formation of the first gap;

third means for inserting a solid electrical insulator between the one contact and the terminal as the contacts separate to electrically insulate the second gap;

fourth means for defining with the first means a chamber, pressurization of the chamber separating the contacts;

ignitable means in the chamber, ignition of which pressurizes the chamber;

a second current path; and fifth means for connecting the second path in shunt with the first path after the first gap is formed.

2. The device of claim 1, wherein the second path includes a fuse.

3. The device of claim 1, wherein the one contact is movable away from the other contact and toward the terminal as the contacts separate, and the first means comprises (a) a first electrically insulative member carried by and movable with the one contact so as to be interposed between the contacts as they separate, and (b) a first electrically insulative sleeve through which the one contact is movable and the first insulative member is conformally movable as the contacts separate;

the third means comprises (a) a second electrically insulative member carried by and movable with the one contact so as to be interposed between the one contact and the terminal as the contacts separate, (b) a third electrically insulative member carried by the terminal so as to be interposed between the one contact and the terminal as the contacts separate; and (c) the second and third insulative members conformally telescoping as the contacts separate; and the fifth means comprises (a) sixth means for electrically connecting one end of the second path to the other contact, the other end of the second path being normally electrically unconnected to the terminal, and (b) seventh means responsive to movement of the one contact for electrically connecting the other end of the second path to the terminal after the contacts have separated a predetermined amount.

4. The device of claim 3, wherein: the sixth means further comprises (a) a first electrically conductive member connected to the terminal, and (b) a second electrically conductive member connected to the other end of the second path and separated from the first conductive member; and the seventh means comprises a third electrically conductive member insulated from and movable with the one contact, the third conductive member being separated from the first and second conductive members when the contacts are electrically interconnected and simultaneously contacting the first and second conductive members after the contacts have separated a predetermined amount.

5. The device of claim 4, wherein:

the other contact is stationary;

the terminal is stationary;

the one contact includes a conductive tube movable through the first sleeve;

a second insulative sleeve covers the exterior of the tube and carries the third electrically conductive member;

the second insulative member covers a first portion of the interior of the tube, a second portion of the interior of the tube being uninsulated;

the terminal includes a conductive rod telescoped into the tube;

the third insulative member covers a first portion of the extension of the rod, a second portion of the exterior of the rod being uninsulated;

the first and second conductive members are carried by the first sleeve; and the second portion of the interior of the tube electrically engages the second portion of the exterior of the rod when the contacts are electrically interconnected; the second portion of the exterior of the rod is first in sliding electrical engagement with the second portion of the interior of the tube and then in sliding engagement with the second insulative member as the contacts separate; and the second portion of the interior of the tube is first in sliding electrical engagement with the second portion of the exterior of the rod and then in sliding engagement with the third insulative member as the contacts separate.

6. The device of claim 5, wherein the dimensions, relative positions and configurations of the tube, the rod, the first, second and third insulative members, the second sleeve and the first, second and third conductive members are selected so that the formation of the first and second gaps and the connection of the other end of the second path to the terminal occur in a predetermined sequence.

7. The device of claim 6, wherein the other end of the second path is connected to the terminal after formation of the first gap and before formation of the second gap.

8. The device of claim 3, 4, 6 or 7, wherein the second path includes a fuse.

9. An electrical switch for opening a first current path in which the switch is included, comprising:

a terminal in the first path;

a pair of normally electrically interconnected contacts which are separable along a first line of direction to both break the electrical interconnection and to form a first gap therebetween, the one contact being movable away from the other contact and toward the terminal as the contacts separate;

first means for inserting a solid electrical insulator between the contacts as they separate to electrically insulate the first gap, said first means including a first electrically insulative member carried by and movable with the one contact so as to be interposed between the contacts as they separate, and an electrically insulative sleeve through which the one contact is movable and the first insulative member is conformally movable as the contacts separate;

second means for electrically connecting one contact to the terminal when the contacts are interconnected, a second gap forming between the one contact and the terminal as the contacts separate at a predetermined time after the formation of the first gap;

third means for inserting a solid electrical insulator between the one contact and the terminal as the contacts separate to electrically insulate the second galp, said third means including a second electrically insulative member carried by and movable with the one contact so as to be interposed between the one contact and the terminal as the contacts separate and a third electrically insulative member carried by the terminal so as to be interposed between the one contact and the terminal as the contacts separate, wherein the second and third insulative members conformally telescope as the contacts separate;

fourth means for defining with the first means a chamber, pressurization of the chamber separating the contacts;

ignitable means in the chamber, ignition of which pressurizes the chamber;

a second current path; and fifth means for connecting the second path in shunt with the first path after the first gap is formed.

10. The switch of claim 9 or 1, wherein said fifth means connects the second path in shunt with the first path before the second gap is formed.

11. The switch of claim 9 or 1, wherein said fifth means connects the second path in shunt with the frst path as the second gap is formed.

12. An electrical switch for opening a first current path in which the switch and a terminal are included, comprising:

a second current path;

first and second normally electrically interconnected contacts for carrying current in the first current path, the first contact being relatively movable along a fixed line of direction away from the second contact to break the electrical interconnection therebetween;

first piston means on the first contact for (a) defining an enclosed chamber with the second contact when the contacts are interconnected;

(b) interpositioning between the contacts to isolate the first contact from the chamber and electrically insulating the contacts from each other as and after the first contact moves away from the second contact, and wherein the first piston means forms an insulative first gap between the contacts as and after the first contact moves away from the second contact;

(c) constricting any arc formed between the contacts after the first contact moves away from the second contact;

second means for (a) electrically connecting the first contact to the terminal when the contacts are electrically interconnected, and (b) inserting a solid electrical insulator between the one contact and the terminal to electrically insulate the first contact from the terminal after the first contact moves away from the second contact, wherein the second means forms an insulated second gap between the first contact and the terminal at a predetermined time after the formation of the first gap;

third means for electrically connecting the second path in shunt with the first path after the first gap is formed and before the second gap is formed; and ignitable means in the chamber for pressurizing the chamber upon ignition thereof to rapidly drive the first contact away from the second contact.

13. The device of claim 1, wherein the second path includes a fuse.

14. The device of claim 13, wherein the isolating, insulating and constricting functions of the first piston means sufficiently elevate the voltage of any arc formed between the contacts so that current in the first path transfers to the second path when the third means electrically connects the second path in shunt with the first path and so that when the second gap forms no arcing between the first contact and the terminal occurs, the second gap being thus initially uncontaminated, the insulating function of the second means prevents both formation of any arc in the second gap and retransfer of the current from the second path to the first path as the fuse operates.

15. A high-voltage fuse having a high continuous current rating, comprising:

a first current path having a high continuous current-carrying capacity;

a second current path;

a fuse in the second path;

first means for opening a first insulated gap in the first path, an arc forming in the first gap;

second means for connecting the second path in shunt with the first path as the voltage of the arc in the first gap elevates to transfer current from the first path to the second path; and third means for opening a second insulated gap in the first path after current therein transfers to the second path so that the second gap is uncontaminated and so that as the arc voltage of the fuse elevates, retransfer of the current to the first path is prevented by the presence of the first gap and the second uncontaminated gap in the first path.

16. The fuse of claim 15, which is a current-limiting fuse having low let-through, wherein the fuse is a current-limiting fuse.

17. The fuse of claim 15 or 16, wherein the second path surrounds the first path, and which further comprises an insulative housing enclosing both paths.

18. The fuse of claim 20 or 16, wherein the first means comprises a pair of normally electrically interconnected contacts separable along a fixed line of direction to form the first gap, means for electrically insulating the first gap as the contacts separate, and ignitable means, ignition of which separates the contacts; and the third means comprises a terminal electrically connected to one contact when the contacts are interconnected, the second gap forming between the terminal and the one contact as the contacts separate, and means for electrically insulating the second gap as the contacts separate.

* * * * *

UNITED STATES PATENT AND TRADEMARK OFFICE

CERTIFICATE OF CORRECTION

PATENT NO. : 4,490,707

DATED : December 25, 1984

INVENTOR(S) : Raymond P. O'Leary

It is certified that error appears in the above-identified patent and that said Letters Patent are hereby corrected as shown below:

Column 1, line 14, "patent application" should be --Patent Applications--.

Column 1, line 16, after "Meister" insert --and--.

Column 1, line 46, "currents" should be --currents,--.

Column 5, line 44, "contaminated" should be --contaminants--.

Column 7, line 38, "cyclophatic" should be --cycloaliphatic--.

Column 8, line 51, "of" should be --or--.

Column 8, line 55, "74," should be --74',--.

Column 9, line 3, "68'," should be --68'--.

UNITED STATES PATENT AND TRADEMARK OFFICE

CERTIFICATE OF CORRECTION

PATENT NO. : 4,490,707

DATED : December 25, 1984

INVENTOR(S) : Raymond P. O'Leary

It is certified that error appears in the above-identified patent and that said Letters Patent are hereby corrected as shown below:

Column 11, line 3, "adjuted" should be --adjusted--.

Column 11, line 11, "128 and 128" should be --128 and 130--.

Column 11, line 22, "frst" should be --first--.

Column 12, line 58, "extension" should be --exterior--.

Column 13, line 50, "galp" should be --gap--.

Column 16, line 5, "20" should be --15--.

In the Abstract, line 22, "communtation" should be --commutation--.

Signed and Sealed this

*Twenty-second* Day of *October 1985*

[SEAL]

*Attest:*

DONALD J. QUIGG

*Attesting Officer*

*Commissioner of Patents and Trademarks—Designate*

UNITED STATES PATENT AND TRADEMARK OFFICE

CERTIFICATE OF CORRECTION

PATENT NO. : 4,490,707

DATED : December 25, 1984

INVENTOR(S) : Raymond P. O'Leary

It is certified that error appears in the above—identified patent and that said Letters Patent is hereby corrected as shown below:

IN THE DRAWINGS

Delete Figure 2.

Figure 3:
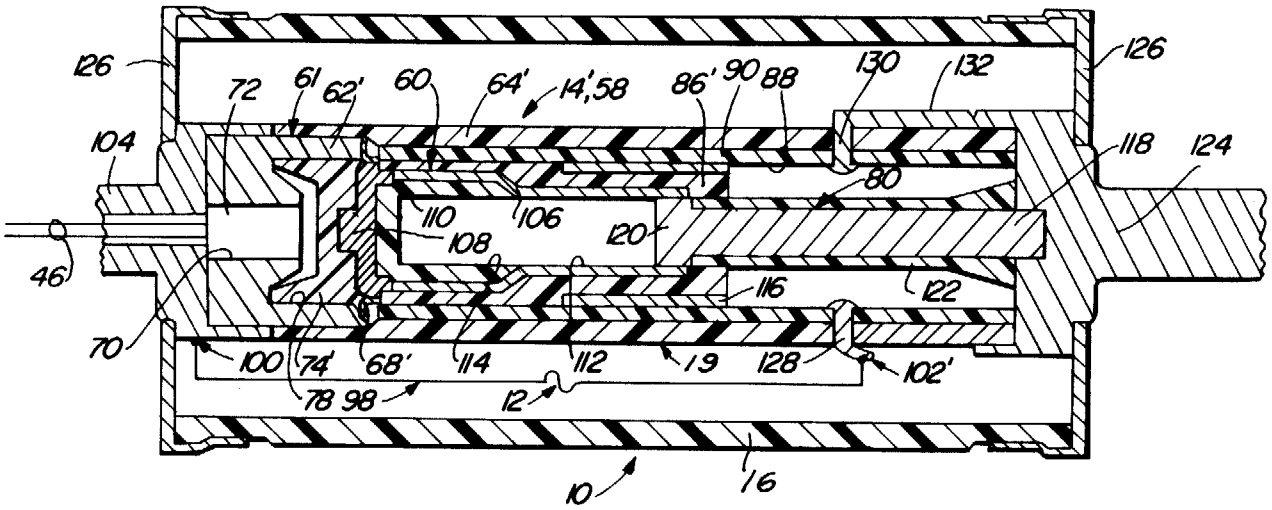

In Figure 3, change "FIG. 3" to -- FIG. 2--.

Signed and Sealed this

*Eighteenth* Day of *March 1986*

[SEAL]

*Attest:*

DONALD J. QUIGG

*Attesting Officer*

*Commissioner of Patents and Trademarks*